US006640553B1

(12) United States Patent
Kotsubo et al.

(10) Patent No.: US 6,640,553 B1
(45) Date of Patent: Nov. 4, 2003

(54) PULSE TUBE REFRIGERATION SYSTEM WITH TAPERED WORK TRANSFER TUBE

(75) Inventors: Vincent Kotsubo, Superior, CO (US); Bayram Arman, Grand Island, NY (US); Dante Patrick Bonaquist, Grand Island, NY (US); Arun Acharya, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/299,912

(22) Filed: Nov. 20, 2002

(51) Int. Cl.[7] ..... F25B 9/00
(52) U.S. Cl. ..... 62/6
(58) Field of Search ..... 62/6

(56) References Cited

U.S. PATENT DOCUMENTS

| | | | | |
|---|---|---|---|---|
| 5,522,223 A | * | 6/1996 | Yanai et al. | 62/6 |
| 5,953,920 A | | 9/1999 | Swift et al. | 62/6 |
| 5,966,943 A | * | 10/1999 | Mitchell | 62/6 |
| 5,974,807 A | | 11/1999 | Gao et al. | 62/6 |
| 6,205,812 B1 | | 3/2001 | Acharya et al. | 62/607 |
| 6,336,331 B1 | | 1/2002 | White et al. | 62/48.2 |
| 6,343,475 B1 | * | 2/2002 | Ishikawa | 62/6 |
| 6,374,617 B1 | | 4/2002 | Bonaquist et al. | 62/6 |
| 6,425,250 B1 | | 7/2002 | Acharya et al. | 62/6 |
| 6,442,947 B1 | * | 9/2002 | Mitchell | 62/6 |

FOREIGN PATENT DOCUMENTS

JP 2001-133063 * 5/2001

OTHER PUBLICATIONS

Olson et al., "Suppression of Acoustic Streaming in Tapered Pulse Tubes", Cryocoolers 10 (1999) pp. 307–313.
Swift et al., "Performance of a Tapered Pulse Tube", Cryocoolers 10 (1999) pp. 315–320.

* cited by examiner

*Primary Examiner*—William C. Doerrler
(74) *Attorney, Agent, or Firm*—Stanley Ktorides

(57) ABSTRACT

A pulse tube refrigeration system, having a pulse generator, a regenerator and a pulse tube, comprising a work transfer tube interposed between the pulse generator and the regenerator wherein the work transfer tube has a cross section at the end proximate the pulse generator which differs from the cross sectional area proximate the regenerator, enabling a reduction in heat transfer due to streaming within the work transfer tube.

21 Claims, 2 Drawing Sheets

PULSE TUBE REFRIGERATION SYSTEM WITH TAPERED WORK TRANSFER TUBE

TECHNICAL FIELD

This invention relates generally to pulse tube refrigeration systems.

BACKGROUND ART

A recent significant advancement in the field of generating refrigeration is the pulse tube system wherein pulse energy is converted to refrigeration using an oscillating gas. In such pulse tube systems a pulse is provided to a working gas which is then cooled in a regenerator. The cooled oscillating gas is expanded in the cold end of a pulse tube and the resulting refrigeration is used to cool, liquefy, subcool and/or densify a product fluid. The oscillating gas then cools the regenerator for the next pulse cycle.

The application of pulse tube technology has primarily been for small quantities of refrigeration typically at very low temperatures. There are a number of very attractive features of pulse tube refrigeration systems that are already in service for small refrigeration requirements. Among such attractive features are no cold moving parts, low maintenance and corresponding high reliability, ease of fabrication, no vibration and low cost. Most of these features are also strong incentives for scale up to industrial size. However one deterrent to large scale application of pulse tube refrigeration is the relatively high power requirement needed to generate the refrigeration.

Accordingly, it is an object of this invention to provide a pulse tube refrigeration apparatus which can be used to generate refrigeration with less power on a unit refrigeration basis than can heretofore available pulse tube systems.

SUMMARY OF THE INVENTION

The above and other objects, which will become apparent to those skilled in the art upon a reading of this disclosure, are attained by the present invention which is:

A pulse tube refrigeration apparatus comprising:

(A) a pulse generator;

(B) a work transfer tube having a receiving end for receiving a pulse from the pulse generator, and a dispensing end in flow communication with a regenerator, said receiving end having a cross sectional area which differs from the cross sectional area of the dispensing end;

(C) a pulse tube in flow communication with the regenerator; and (D) a cold heat exchanger disposed between the regenerator and the pulse tube.

As used herein the terms "pulse" and "pressure wave" mean energy which causes a mass of gas to go through sequentially high and low pressure levels in a cyclic manner.

As used herein the term "orifice" means a gas flow restricting device placed between the warm end of a pulse tube and a reservoir.

As used herein the term "regenerator" means a thermal device in the form of porous distributed mass, such as spheres, stacked screens, perforated metal sheets and the like, with good thermal capacity to cool incoming warm gas and warm returning cold gas via direct heat transfer with the porous distributed mass.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

As used herein the term "work transfer tube" means a tube wherein a pulse or pressure wave is transferred in an adiabatic manner.

DETAILED DESCRIPTION

The invention employs a work transfer tube interposed between the pulse generator and the regenerator of a pulse tube system. The use of the work transfer tube enables the production of more refrigeration from the same pulse tube and driver system. A major problem with work transfer tubes is streaming which is the transfer of heat from the hot end to the cold end of a work transfer tube due to secondary flows. The invention solves the streaming problem by employing a work transfer tube having a receiving end proximate the pulse generator which has a cross sectional area which differs from that of the dispensing end of the work transfer tube which is proximate the regenerator. That is, the work transfer tube is tapered. Preferably the taper of the work transfer tube is continuous from the edge of the receiving end to the edge of the dispensing end. In the practice of this invention the work transfer tube has a taper in which the receiving end can be larger than the dispensing end connected to the regenerator or vice versa depending upon the phase shift angle and the temperature level of the refrigeration produced.

Figure 1:
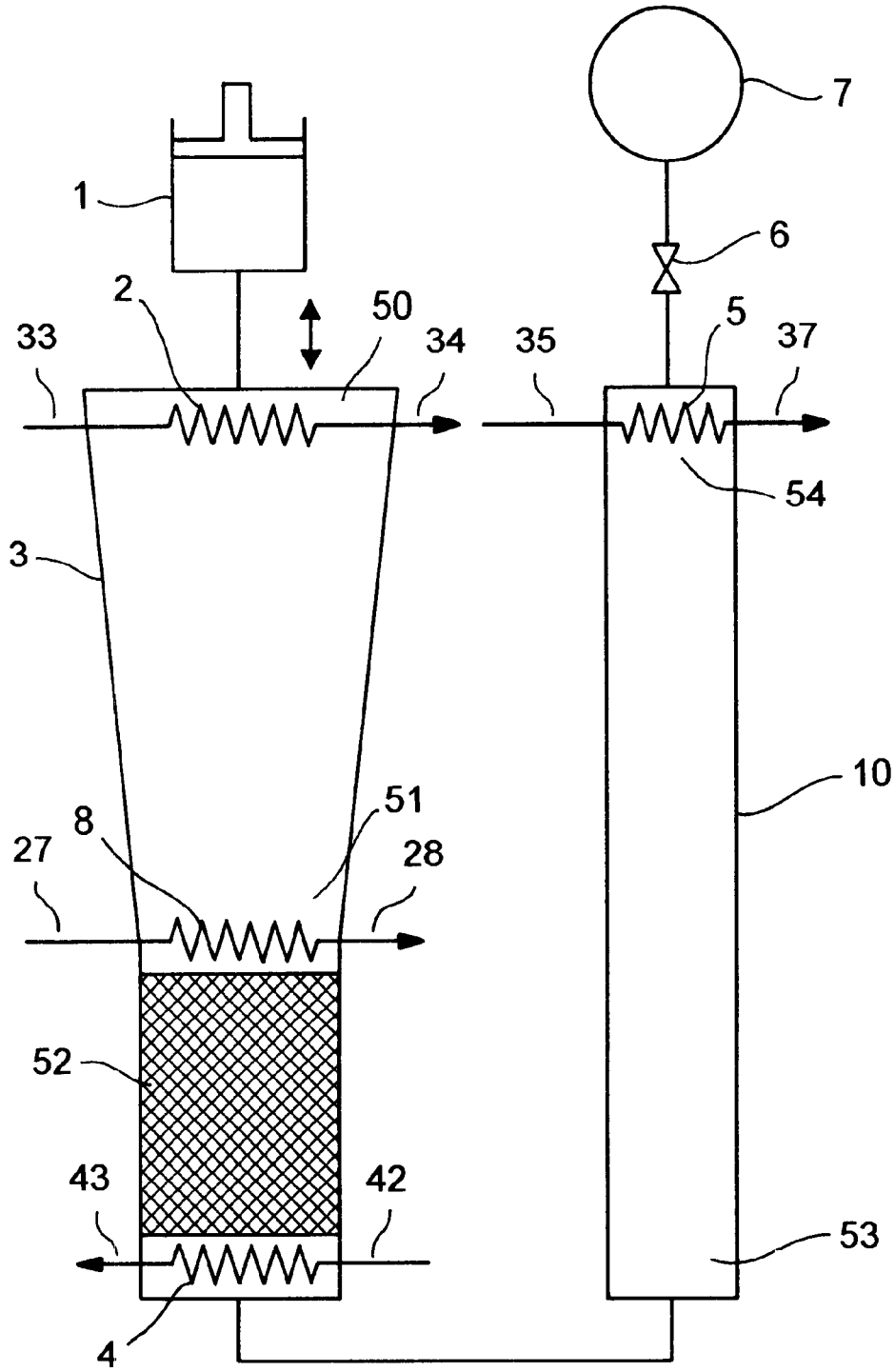
FIG. 1 is a cross sectional representation of one preferred embodiment of the pulse tube refrigeration apparatus of this invention.

The invention will be discussed in greater detail with reference to FIG. 1 wherein there is illustrated one embodiment of the invention wherein the cross sectional area of the receiving end of the work transfer tube exceeds the cross sectional area of the dispensing end of the work transfer tube. In FIG. 1 there is illustrated a pulse generator 1 which provides a pulse or pressure wave to a working gas at the receiving end 50 of work transfer tube 3. In the embodiment of the invention illustrated in FIG. 1 the pulse generator is a piston. Another preferred means of applying the pulse to the work transfer tube is by the use of a thermoacoustic driver which applies sound energy to the working gas within the work transfer tube. Yet another way for applying the pulse is by means of a linear motor/compressor arrangement. Yet another means to apply the pulse is by means of a loudspeaker. Another preferred means to apply the pulse is by means of a travelling wave engine. The pulse serves to compress the working gas producing hot compressed working gas at the hot end or receiving end 50 of work transfer tube 3. The working gas is cooled by indirect heat exchange with heat transfer fluid 33 in heat exchanger 2 resulting in warmed heat transfer fluid in stream 34 and to produce ambient temperature compressed working gas for passage through the remainder of the work transfer tube 3. Examples of fluids useful as heat transfer fluid 33, 34 in the practice of this invention include water, air, ethylene glycol and the like.

Work transfer tube 3 is a hollow or empty tube wherein pressure-volume (PV) work is transferred from one temperature level to a lower temperature level without significant loss. The working gas within the work transfer tube is preferably helium although other gases or gas mixtures, such as nitrogen, argon, neon and mixtures comprising one or more of these gases may be used. In the embodiment of the invention illustrated in FIG. 1, the cross sectional area of the receiving end or hot end 50 of work transfer tube 3 exceeds the cross sectional area of the dispensing end or cold end 51 of work transfer tube 3. The work transfer tube is tapered from its receiving end to its dispensing end. Preferably, as illustrated in FIG. 1, the taper is continuous from the receiving end to the dispensing end. The taper angle between the receiving end and the dispensing end of the pulse tube is 25 degrees or less and generally is within the range of from 1 to 10 degrees, although it may also be a negative angle depending upon the phase shift angle and the temperature level of the refrigeration desired.

In the embodiment of this invention wherein the cross sectional area of the receiving end of the work transfer tube exceeds the cross sectional area of the dispensing end of the work transfer tube, the ratio of the diameter of the receiving end to the diameter at the midpoint of the work transfer tube is within the range of from 1.01 to 2.0, and the ratio of the diameter of the dispensing end to the diameter at the midpoint of the work transfer tube is within the range of from 0.2 to 0.99.

The embodiment of the invention illustrated in FIG. 1 is a particularly preferred embodiment wherein a forecooler 8 is incorporated at the dispensing end 51 of work transfer tube 3. The forecooler serves to cool the working gas by indirect heat exchange with forecooling fluid which is provided to forecooler 8 in line 27 and withdrawn from forecooler 8 in line 28. The forecooling fluid provided to forecooler 8 is preferably liquid nitrogen. Other fluids which may be used as the forecooling fluid in the practice of this invention include argon, air, neon and helium.

The tapered work transfer tube, preferably forecooled tapered work transfer tube, enables a reduced pressure drop in the system and optimized refrigeration production at a reduced overall power requirement, i.e. PV power in the system plus cryogen usage. The forecooling need not be at the dispensing end of the tapered work transfer tube but could be at one or more interior locations of the work transfer tube. Moreover the forecooling could be at both the dispensing end and at one or more interior locations of the work transfer tube. In a preferred embodiment of the invention, forecooling fluid 28 from forecooler 8 is directed so as to cool the working gas in the interior of the work transfer tube either by means of one or more intermediate heat exchangers disposed in the interior of the work transfer tube or by means of a wall heat exchanger disposed longitudinally along the wall of the work transfer tube. Moreover, forecooling may be provided by a different refrigerator via conduction coupling.

The forecooled pulsing working gas is then provided to regenerator 52, which is in flow communication with dispensing end 51 of work transfer tube 3, and wherein it is further cooled by direct heat exchange with cold heat transfer media to produce warmed heat transfer media and further cooled working gas.

Cold heat exchanger 4 is disposed between regenerator 52 and pulse tube 10 which are in flow communication wherein the flow communication includes cold heat exchanger 4. In the embodiment illustrated in FIG. 1, the cold heat exchanger is within the same housing which holds regenerator 52. It could also be located within the housing which holds the pulse tube or it could be between such elements. The further cooled working gas pulses or oscillates between the regenerator 52 and the cold end 53 of pulse tube 10. The working gas expands in cold end 53 thereby generating refrigeration and compressing the working gas in pulse tube 10 in the direction of warm end 54 of pulse tube 10. The refrigeration generated by the expanding further cooled working gas in cold end 53 is concentrated in cold heat exchanger 4 and is provided by indirect heat exchange to a process fluid which is provided to cold heat exchanger 4 in line 42 and withdrawn in a cooled, i.e. refrigerated, condition in line 43. Process fluids which may be refrigerated using the invention may be any chemical processing stream that requires refrigeration, and may also be a heat transfer fluid which in turn conveys the refrigeration to a point of use.

Cooling fluid 35 is passed to heat exchanger 5 wherein it is warmed or vaporized by indirect heat exchange with the pulse tube working gas, thus serving as a heat sink to cool the pulse tube working gas. Resulting warmed or vaporized cooling fluid is withdrawn from heat exchanger 5 in stream 37. Preferably cooling fluid 35 is water, air, ethylene glycol or the like.

Attached to the warm end of pulse tube 10 is a line having orifice 6 leading to reservoir 7. The compression wave of the pulse tube working gas contacts the warm end wall of the pulse tube body and proceeds back in the second phase of the pulse tube sequence. Orifice 6 and reservoir 7 are employed to maintain the pressure and flow waves in proper phase so that the pulse tube generates net refrigeration during the expansion and the compression cycles in the cold end of pulse tube 10. Other means for maintaining the pressure and flow waves in phase which may be used in the practice of this invention include inertance tube and orifice, expander, linear alternator, bellows arrangements, and a work recovery line with a mass flux suppressor. In the expansion sequence, the pulse tube working gas expands to produce cold pulse tube working gas at the cold end 53 of the pulse tube 10. The expanded gas reverses its direction such that it flows from pulse tube 10 toward regenerator 52.

The pulse tube working gas emerging from the pulse tube passes to regenerator 52 wherein it directly contacts the heat transfer media within the regenerator body to produce the aforesaid cold heat transfer media, thereby completing the second phase of the pulse tube refrigerant sequence and putting the regenerator into condition for the first phase of a subsequent pulse tube refrigeration sequence.

In the practice of this invention the pulse tube 10 contains only gas for the transfer of the pressure energy from the expanding pulse tube working gas at the cold end for the heating of the pulse tube working gas at the warm end of the pulse tube. That is, pulse tube 10 contains no moving parts. The operation of the pulse tube without moving parts is a significant advantage of this invention. The pulse tube may have a taper to aid adjustment of the proper phase angle between the pressure and flow waves. In addition, the pulse tube may have a passive displacer to help in separating the ends of the pulse tube. Furthermore, the pulse tube may have a connecting line between the pulse tube warm end and the pressure wave line replacing the orifice and reservoir with a mass flux suppressor such as a bellows arrangement to recover lost work. Furthermore, in the preferred practice of this invention, flow straighteners are positioned at both ends of the work transfer tube and also at both ends of the pulse tube to provide uniform flow distribution of gas into the work transfer tube and to prevent jetting of gas in the pulse tube, Streaming is steady convection which is driven by the oscillatory process. Streaming is strongly dependent upon the taper angle, amplitudes of gas velocity and gas pressure, and the phase angle between the gas velocity and gas pressure. It is proportional to 1/T and the temperature difference between the two ends of the work transfer tube, and it scales as the square of the acoustic amplitudes. A particle of gas close to the tube wall will be farther from the wall during its upward motion than during its downward motion because of the compressibility of the gas in the boundary layer and the phasing between the oscillatory motion and pressure. The drag on the particle will be different during its upward motion than during its downward motion and thus the particle will not return to its original starting position after a complete cycle or oscillation. This effect near the tube wall causes an offset parabolic velocity profile with the gas velocity near the wall equal to the drift velocity just outside the penetration depth and the velocity in the center of the work transfer tube determined by the requirement that the net mass flux along the tube must be zero. This parabolic streaming convects heat through the tube. The gas moving downward in the center of the tube is hotter than the gas moving upward around it, so that heat is carried downward toward the cold end.

Streaming can be essentially eliminated by the incorporation of the optimum taper angle in the work transfer tube. There is a small amount of streaming near the wall and a correspondingly small offset flux in the remainder of the tube. This carries essentially no heat. The only important effect to be considered here is the temperature effect on the viscosity and the temperature is lower in the upward motion of the gas than during the downward motion of the gas adjacent to the wall.

The key parameter for the successful transfer of work within a work transfer tube is controlling the internal streaming. The adjustment of phasing between pressure and flow will permit control of streaming in one axial location such that there is zero streaming velocity. The streaming on the other end of the work transfer tube is controlled by the use of a tapered tube configuration.

The angle of taper for the work transfer tube can be determined by the following correlation:

$$\tan(\phi/2) = (7.4\cos\theta + 6.3\sin\theta)\frac{R^3 f|p_1|}{P_m|U_m|} + 0.029\frac{Rd\,Tm}{Tmdx}$$

Where $\phi$=work transfer tube taper angle, degrees $\theta$=phase shift, degrees R=internal radius, meters $f$=frequency, Hz

|p1|=amplitude of oscillating pressure, Pa

Pm=mean pressure, Pa

|Um|=amplitude of volumetric velocity, meters$^3$/sec

Tm=absolute temperature, K x=radial distance, meters

For the tapered work transfer tube of length L and a diameter D at the midpoint of the length, and having a single uniform taper, the larger and smaller end diameters, $D_{large}$ and $D_{small}$, are given by:

$$D_{large}=D+L\tan\phi$$

$$D_{small}=D-L\tan\phi$$

Figure 2:
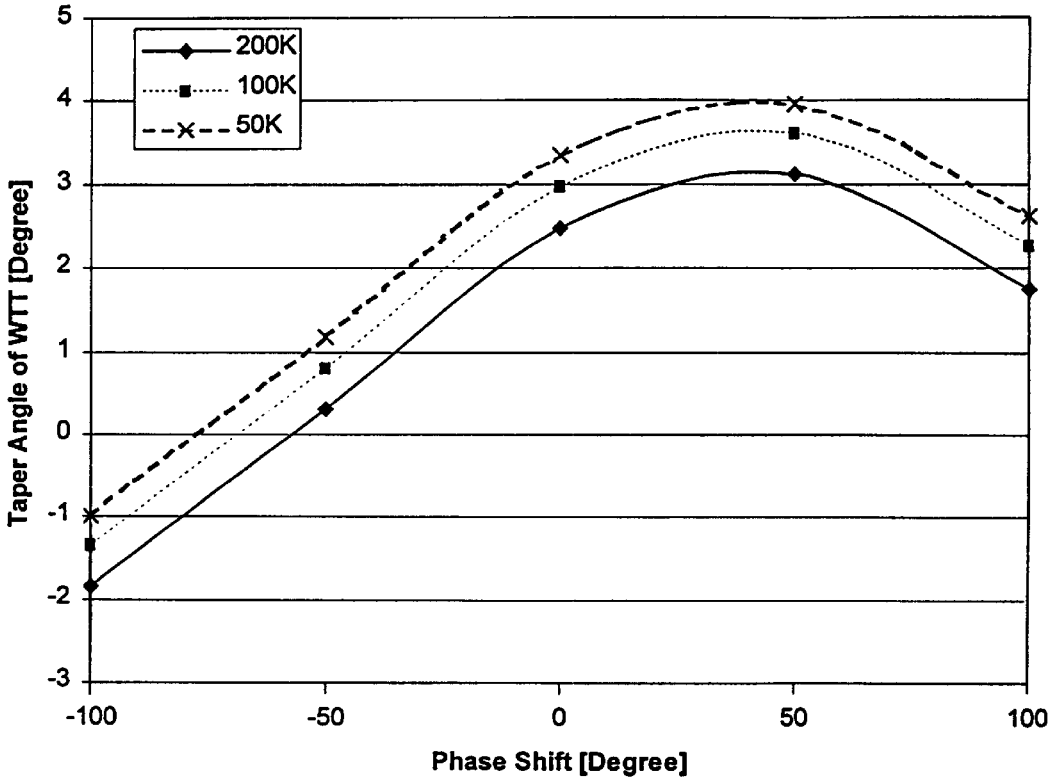
FIG. 2 is a graphical representation of the results of one example of a correlation showing the taper angle of the work transfer tube versus phase shift at various refrigeration levels.

Using, as an example, helium as the working gas in a pulse tube refrigerator having a work transfer tube internal radius of 0.05 meters, a volumetric velocity of 0.2 meters per second, a mean pressure of $3.1\times10^6$ Pa, and an ambient temperature of 300 K, the results are shown in the correlation of FIG. 2. In general, the taper angle of the work transfer tube increases from a small negative value at negative phase-shift angles to a maximum positive angle of three to four degrees at phase-shift angles of approximately 50 degrees. Correlations are given for refrigeration levels of 50, 100 and 200 K, the taper angles being slightly greater for the lower temperatures.

The relative costs of PV power and additional refrigeration liquid nitrogen will determine the most economical operating point. Up to a given point, the use of higher level refrigeration (liquid nitrogen) in place of lower temperature refrigeration of the pulse tube (PV work) permits the determination of the most favorable operating condition.

Table 1 presents the calculated operating results of the invention, shown in column B, for a system similar to that illustrated in FIG. 1, compared to a conventional system with no tapered work transfer tube between the pulse generator and the regenerator shown in column A. The process fluid is neon and the systems generate 500 watts of refrigeration at 30 K to liquefy the neon. As can be seen, the invention in this instance enables the liquefaction of neon with about half of the energy required with the conventional system.

TABLE 1

| | A | B |
|---|---|---|
| PV Work (kW) | 15.6 | 4.1 |
| $LN_2$ Consumption (kW) | 1.1 | 4.8 |
| Total Energy (kW) | 16.7 | 8.9 |

although the invention has been described in detail with reference to a certain particularly preferred embodiment, those skilled in the art will recognize that there are other embodiments of the invention within the spirit and the scope of the claims.

What is claimed is:

1. A pulse tube refrigeration apparatus comprising:

(A) a pulse generator;

(B) a work transfer tube having a receiving end for receiving a pulse from the pulse generator, and a dispensing end in flow communication with a regenerator, said receiving end having a cross sectional area which differs from the cross sectional area of the dispensing end and wherein the work transfer tube is tapered continuously from the receiving end to the dispensing end;

(C) a pulse tube in flow communication with the regenerator; and (D) a cold heat exchanger disposed between the regenerator and the pulse tube.

2. The method of claim 1 wherein the taper of the work transfer tube is at an angle within the range of from 1 to 25 degrees.

3. The apparatus of claim 1 further comprising a forecooler located in the dispensing end of the work transfer tube.

4. The apparatus of claim 3 further comprising means for providing liquid nitrogen to the forecooler.

5. The apparatus of claim 1 wherein the cross sectional area of the receiving end exceeds the cross sectional area of the dispensing end.

6. The apparatus of claim 5 wherein the ratio of the diameter of the receiving end to the diameter at the midpoint of the work transfer tube is within the range of from 1.01 to 2.0.

7. The apparatus of claim 5 wherein the ratio of the diameter of the dispensing end to the diameter at the midpoint of the work transfer tube is within the range of from 0.2 to 0.99.

8. The apparatus of claim 1 wherein the pulse generator comprises a piston.

9. The apparatus of claim 1 wherein the cold heat exchanger is within the housing which holds the regenerator.

10. A pulse tube refrigeration apparatus comprising:

(A) a pulse generator;

(B) a work transfer tube having a receiving end for receiving a pulse from the pulse generator, and a dispensing end in flow communication with a regenerator, said receiving end having a cross sectional area which differs from the cross sectional area of the dispensing end;

(C) a pulse tube in flow communication with the regenerator; and (D) a cold heat exchanger disposed between the regenerator and the pulse tube; and further comprising a forecooler located in the dispensing end of the work transfer tube.

11. The apparatus of claim 10 further comprising means for providing liquid nitrogen to the forecooler.

12. The apparatus of claim 10 wherein the cross sectional area of the receiving end exceeds the cross sectional area of the dispensing end,.

13. The apparatus of claim 12 wherein the ratio of the diameter of the receiving end to the diameter at the midpoint of the work transfer tube is within the range of from 1.01 to 2.0.

14. The apparatus of claim 12 wherein the ratio of the diameter of the dispensing end to the diameter at the midpoint of the work transfer tube is within the range of from 0.2 to 0.99.

15. The apparatus of claim 10 wherein the pulse generator comprises a piston.

16. The apparatus of claim 10 wherein the cold heat exchanger is within the housing which holds the regenerator.

17. A pulse tube refrigeration apparatus comprising:

(A) a pulse generator;

(B) a work transfer tube having a receiving end for receiving a pulse from the pulse generator, and a dispensing end in flow communication with a regenerator, said receiving end having a cross sectional area which differs from the cross sectional area of the dispensing end wherein the cross sectional area of the receiving end exceeds the cross sectional area of the dispensing end;

(C) a pulse tube in flow communication with the regenerator; and (D) a cold heat exchanger disposed between the regenerator and the pulse tube.

18. The apparatus of claim 17 wherein the ratio of the diameter of the receiving end to the diameter at the midpoint of the work transfer tube is within the range of from 1.01 to 2.0.

19. The apparatus of claim 17 wherein the ratio of the diameter of the dispensing end to the diameter at the midpoint of the work transfer tube is within the range of from 0.2 to 0.99.

20. The apparatus of claim 17 wherein the pulse generator comprises a piston.

21. The apparatus of claim 17 wherein the cold heat exchanger is within the housing which holds the regenerator.

* * * * *